US008915052B2

(12) United States Patent
Dewert et al.

(10) Patent No.: US 8,915,052 B2
(45) Date of Patent: Dec. 23, 2014

(54) METHOD AND DEVICE FOR SCREW CAPPING VESSELS, IN PARTICULAR BOTTLES

(75) Inventors: Andreas Dewert, Obertraubling (DE); Klaus Buchhauser, Deuerling (DE); Günter Frankenberger, Kofering (DE)

(73) Assignee: Krones AG, Neutraubling (DE)

( * ) Notice: Subject to any disclaimer, the term of this patent is extended or adjusted under 35 U.S.C. 154(b) by 885 days.

(21) Appl. No.: 12/902,349

(22) Filed: Oct. 12, 2010

(65) Prior Publication Data

US 2011/0083405 A1 Apr. 14, 2011

(30) Foreign Application Priority Data

Oct. 13, 2009 (DE) ..... 10 2009 045 637

(51) Int. Cl.
*B67B 3/20* (2006.01)
*B67B 3/26* (2006.01)

(52) U.S. Cl.
CPC ..... *B67B 3/2033* (2013.01); *B67B 3/20* (2013.01); *B67B 3/208* (2013.01); *B67B 3/26* (2013.01)
USPC ..... 53/490; 53/317; 53/331.5

(58) Field of Classification Search
CPC ..... B67B 3/20; B67B 3/26
USPC ..... 53/490, 75, 317, 331.5
See application file for complete search history.

(56) References Cited

U.S. PATENT DOCUMENTS 5,400,564 A * 3/1995 Humphries et al. ..... 53/75
6,170,232 B1 * 1/2001 VandeGeijn ..... 53/331.5
6,525,498 B2 * 2/2003 Zalkin et al. ..... 318/432
6,679,026 B1 * 1/2004 Cirio ..... 53/317
6,804,929 B2 * 10/2004 Kemnitz ..... 53/75
6,874,301 B2 * 4/2005 Kitamoto ..... 53/490
6,948,297 B2 * 9/2005 Kitamoto ..... 53/490
7,024,837 B2 * 4/2006 Takebe et al. ..... 53/490
7,987,652 B2 * 8/2011 Corniani ..... 53/317
7,992,365 B2 * 8/2011 Uebel et al. ..... 53/490

(Continued)

FOREIGN PATENT DOCUMENTS

DE 60107475 T2 12/2005
DE 102007047742 A1 4/2009

(Continued)

OTHER PUBLICATIONS

German Search Report for DE102009045637.6, dated May 18, 2010.

(Continued)

*Primary Examiner* — Stephen F Gerrity
*Assistant Examiner* — Eyamindae Jallow
(74) *Attorney, Agent, or Firm* — Marshall, Gerstein & Borun LLP

(57) ABSTRACT

A method and a device for screw capping vessels, in particular bottles, by measuring the power consumption of a linear drive system for lifting and lowering the closing head in a pick phase for picking up the respective closing cap and/or in a screw phase for screwing on the closing cap being, and by comparing that measured power consumption with at least one characteristic value of the power consumption to detect an imminent or occurred incorrect closure. In this manner, vessels can be closed at a low error rate and possibly incorrectly closed vessels can be discharged from a continuous product stream at a low error rate.

18 Claims, 3 Drawing Sheets

(56) References Cited

U.S. PATENT DOCUMENTS

| | | | | |
|---|---|---|---|---|
| 2001/0018820 | A1* | 9/2001 | Kitamoto | 53/490 |
| 2002/0116897 | A1* | 8/2002 | Higashizaki et al. | 53/331.5 |
| 2003/0093972 | A1* | 5/2003 | Bouraoui et al. | 53/331.5 |
| 2003/0154688 | A1* | 8/2003 | Lang | 53/75 |
| 2004/0139811 | A1* | 7/2004 | Cirio | 73/865.9 |
| 2004/0216430 | A1* | 11/2004 | Mavin | 53/490 |
| 2005/0022479 | A1* | 2/2005 | Kitamoto | 53/490 |
| 2006/0162285 | A1* | 7/2006 | Haynes et al. | 53/317 |
| 2009/0178370 | A1* | 7/2009 | Uebel et al. | 53/314 |
| 2009/0293437 | A1* | 12/2009 | Schulz et al. | 53/490 |
| 2012/0186194 | A1* | 7/2012 | Schlieper | 53/317 |
| 2013/0239522 | A1* | 9/2013 | Melrose | 53/467 |

FOREIGN PATENT DOCUMENTS

| | | | |
|---|---|---|---|
| DE | 102007057857 | A1 | 6/2009 |
| EP | 0639529 | A1 | 2/1995 |
| EP | 1132331 | A1 | 9/2001 |
| EP | 1182165 | A1 * | 2/2002 |
| JP | 05065191 | A | 3/1993 |
| JP | 2001-278386 | | 10/2001 |
| JP | 2003-025266 | | 1/2003 |
| JP | 2003-081387 | | 3/2003 |
| JP | 2004-131132 | | 4/2004 |
| WO | WO-2007028509 | A1 | 3/2007 |
| WO | WO-2009047172 | A1 | 4/2009 |
| WO | WO-2009068166 | A1 | 6/2009 |

OTHER PUBLICATIONS

Translation of Japanese Office Action issued by Japanese Action on Mar. 18, 2014 in corresponding Japanese Patent Application No. P2010-228648.

* cited by examiner

METHOD AND DEVICE FOR SCREW CAPPING VESSELS, IN PARTICULAR BOTTLES

CROSS-REFERENCE TO RELATED APPLICATION

The present application claims the benefit of priority of German Application No. 102009045637.6, filed Oct. 13, 2009. The entire text of the priority application is incorporated herein by reference in its entirety.

FIELD OF THE DISCLOSURE

The disclosure relates to a method and a device for screw capping vessels, in particular bottles, such as for beverage bottling operations.

BACKGROUND

As is well-known, screw caps of vessels, for example bottles, can be closed in rotary machines with several circumferentially arranged closing stations rotating about a common axle, the closing caps each being held in closing heads which are rotated as well as lowered corresponding to the thread pitch after having been placed onto the respective bottle mouth. As an alternative, the bottles can also be correspondingly lifted while the closing cap is being screwed on.

In this context, it is known from patent publication DE 10 2007 057 857 A1 to accomplish the lifting as well as rotation of a closing head during the closing of a vessel by means of a combined linear-rotatory drive.

It is furthermore known from patent publication DE 10 2007 047 742 A1 to measure the torque or the power consumption of a motor for rotating the closure, in particular when a pilfer-proof band provided at the closure is applied, to be able to separately adjust and check the maximum torque when the pilfer-proof band is applied and when the closure is finally tightened.

However, there still is a demand to close vessels with a lower error rate as well as to be able to discharge possibly incorrectly closed vessels from a continuous product stream at a low error rate, in particular using a closing head with a linear-rotatory drive.

SUMMARY OF THE DISCLOSURE

It is an aspect of the disclosure to provide a method for closing vessels improved in this respect and a corresponding device.

This aspect is achieved with a method in which the power consumption of the linear drive system of the closing head is measured in a pick phase for picking up the respective closing cap and/or in a screw phase for screwing on the closing cap, and is compared with at least one characteristic value of the power consumption to detect an imminent or already occurred incorrect closure. The power consumption of the linear drive system can be used as measure for the pressing force of the closing head and thus permit a direct conclusion about the contact between the closing head and the closing cap or the closing cap and the vessel mouth, respectively. Depending on the specification or selection of the characteristic value, individual phases of picking up and screwing on the closing cap can be selectively controlled. In this respect, a characteristic value is an individual value, such as a threshold value, or a flow of current, such as a positive or a negative peak load, which serves as reference value in a certain time section of the method to be able to decide whether the closing procedure is correct or incorrect. The term power consumption is representatively used for all electric variables that directly or indirectly correlate with the spent motor output, in particular as a measure for an applied pressing force of the closing head or the closing cap, respectively.

Preferably, the position of the closing head with respect to the linear axle of the linear drive system is moreover determined. Thereby, a position of the closing head can be associated to individual measured values of power consumption. Correspondingly, one can verify whether a current value at a certain position is admissible or not and thus improve the reliability of error detection. Equally, one can gather a possible change of the position of the closing head along the linear axle from a certain course of power consumption.

Preferably, the characteristic value is an upper threshold value of the power consumption in the pick phase. When the upper threshold value is exceeded, one can gather an inadmissibly high pressing force and thereby detect or decide whether or that the closing cap is deformed and/or not correctly screwed on. Thereby, an imminent incorrect closure can be determined or an incorrect closure can be avoided.

Preferably, the characteristic value is a lower threshold value of the power consumption in the pick phase. If the lower threshold value is fallen below, one can gather an inadmissibly low pressing force and detect or decide thereby whether or that the closing cap or a pilfer-proof band of the closing cap is missing. Thereby, an imminent incorrect closure can be detected or an incorrect closure can be avoided.

Preferably, the characteristic value is a characteristic peak of the power consumption in the pick phase, and it is verified whether the characteristic peak occurs in the pick phase. Overcoming a mechanical resistance when the closing cap engages in the closing head generates a momentary increase of power consumption. If the characteristic peak load occurs, one can therefore detect or decide whether or that the closing cap has been correctly picked up by the closing head. Thereby, one can say that a closing cap can be screwed on correctly with a particularly. high probability. In particular in combination with a comparison of the power consumption and the travel of the linear axle with at least one threshold value, the informative value of the verification can be additionally increased and quality assurance improved.

Preferably, the characteristic value is an upper threshold value of the power consumption in the screw phase. If the upper threshold value is exceeded, one can gather an increased mechanical resistance during screwing on, as it arises, for example, when a pilfer-proof band approaches the bottle mouth. One can thus detect or decide whether or that a pilfer-proof band has been correctly attached. Thereby, the quality of the closure can be ensured.

Preferably, the characteristic value is a characteristic peak of the power consumption in the screw phase in particular during rotation against the closing direction, and by means of the characteristic peak, a starting position of the closing head at the beginning of the thread formed by the closing cap and the vessel mouth is determined. Thereby, a reference value for an absolute position determination of the bottle mouth can be detected. Such a determination is largely independent of tolerances of individual closing stations and therefore particularly precise.

Preferably, by means of the starting position at the begin of the thread, a lower desired end position of the closing head is calculated, and the power consumption when the desired end position is reached is compared to a further characteristic value of power consumption. Thereby, the threaded joint can be checked at a defined end point of the screw phase. This permits a final check of the screw operation.

Preferably, the further characteristic value is a lower threshold value of the power consumption in the screw phase. If the lower threshold value is fallen below, one can detect or decide whether or that the closing cap is not correctly screwed on or the vessel mouth is missing. By this, incorrect closure can be detected.

Preferably, the vessels are fed as continuous product stream, and vessels detected to be incorrectly closed are discharged from the product stream. One can thereby ensure that only perfectly closed bottles are processed further.

The technical aspect is furthermore achieved with a device for screw capping vessels, where a measuring means for measuring the power consumption of the linear drive system as well as an evaluation means for comparing the power consumption measured during picking up and/or screwing on the closing cap with a characteristic value of the power consumption to detect an imminent incorrect closure or an incorrect closure are provided. With the measuring means, a measure for the pressing force of the closing head can be determined and one can thus directly gather the contact between the closing head and the closing cap or the closing cap and the vessel mouth.

A particularly advantageous embodiment furthermore comprises a monitoring means for determining the position of the closing head with respect to the linear axle. Thereby, a position of the closing head can be associated to individual measured values of power consumption. One can correspondingly verify whether a current value at a certain position is admissible or not and thus improve the reliability of error detection. Equally, one can gather a possible change of position of the closing head along the linear axle from a certain course of power consumption.

An advantageous embodiment furthermore comprises a discharge device for discharging incorrectly closed vessels. One can thereby ensure that only correctly closed vessels are processed further.

Preferably, the device according to the disclosure comprises a control device which can control the linear drive system and the rotatory drive system such that only closing caps for which no imminent incorrect closure has been detected are screwed on.

It is also possible to influence the speed of the axis of rotation during screwing on on the mouth by the power consumption of the linear axle, for example to adjust the system to changed pitches and/or heights of the mouth/closure. Here, it would be conceivable to set up a kind of self-learning system where only start and end angles and characteristic threshold values influence the system.

BRIEF DESCRIPTION OF THE DRAWINGS

A preferred embodiment of the disclosure is represented in the drawing. In the drawings.

DETAILED DESCRIPTION OF THE PREFERRED EMBODIMENT

Figure 1:
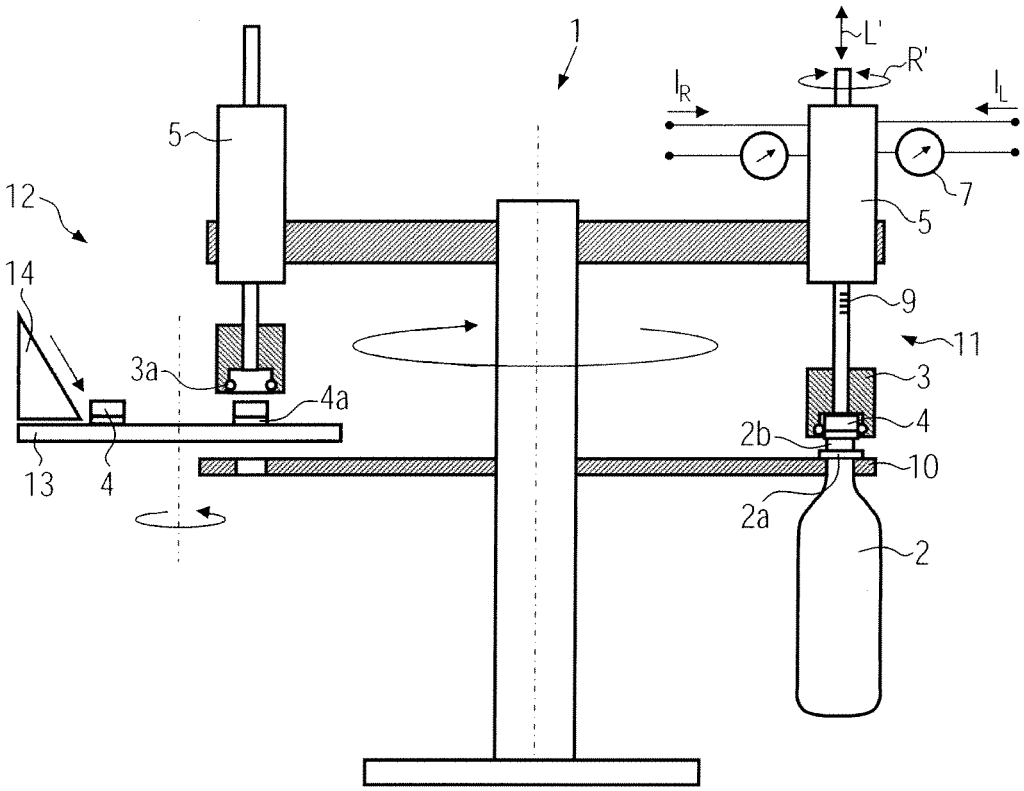
FIG. 1 shows a schematic representation of a device according to the disclosure.

As one can see in FIG. 1, an embodiment according to the disclosure of the device 1 for closing bottles 2 or similar vessels is designed as rotary machine with several closing heads 3 uniformly and circumferentially distributed at the device 1 for picking up and holding one screw-type cap 4 each to which one motor 5 each, for example a servomotor, is associated for lifting or lowering the closing head 3 by means of a linear drive system L and for rotating the closing head 3 by means of a rotatory drive system R (drive systems L, R, not represented separately). The motors 5 could also be stepper motors or any linear motors, where the drive systems L, R do not necessarily have to be combined in one motor or housing, respectively. Devices for guiding in and out the bottles 2 are well-known in prior art and therefore not represented.

For the sake of simplicity, there are schematically indicated only for the right motor 5 electric supply lines with electric current meters 7 for measuring the electric currents IL and IR flowing through the drive systems L, R, as well as a monitoring device 9 for determining the position y of the closing head 3 with respect to the linear axle L' of the motor 5. The monitoring device 9 could be, for example, a component of a servo drive system. The axis of rotation R' is also indicated for the sake of good order, the systems L, R driving the closing head 3 via a common shaft.

In combination with a neck star 10 for holding the bottles 2 to be closed at their collars 2*a*, the closing heads 3 each form closing stations 11 over a certain angular machine range, as indicated in the right of FIG. 1. To hold in particular PET bottles 2 in the neck star 10 protected against rotation, elevations or spikes are provided in the same which can be engaged with corresponding recesses in the bottle collars 2*a* (not represented in detail). However, glass bottles or else returnable PET bottles could be held instead protected against rotation in a well-known manner, e.g. via belt clamping.

In the left of FIG. 1, a pick station 12 is represented which is formed by the closing heads 3 with a pick wheel 13 and a supply 14 for the screw-type caps 4. Here, the closing caps 4 are provided on the pick wheel 13 in synchronization with the closing heads 3 and taken or picked up by the same by lowering them over the respective closing cap 4. To this end, a centering and clamping device 3*a* for the closing cap 4 is preferably provided in the closing head 3, for example in the form of spring-borne circumferential spheres.

Figure 2:
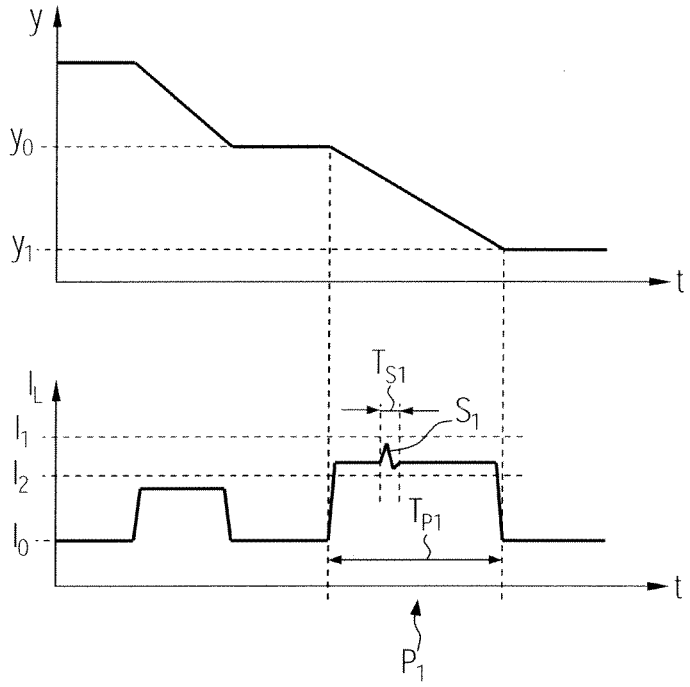
FIG. 2 shows a schematic place-time diagram of the closing head during picking up of a closing cap and a corresponding current-time course of a linear drive system of the closing head.
Figure 3:
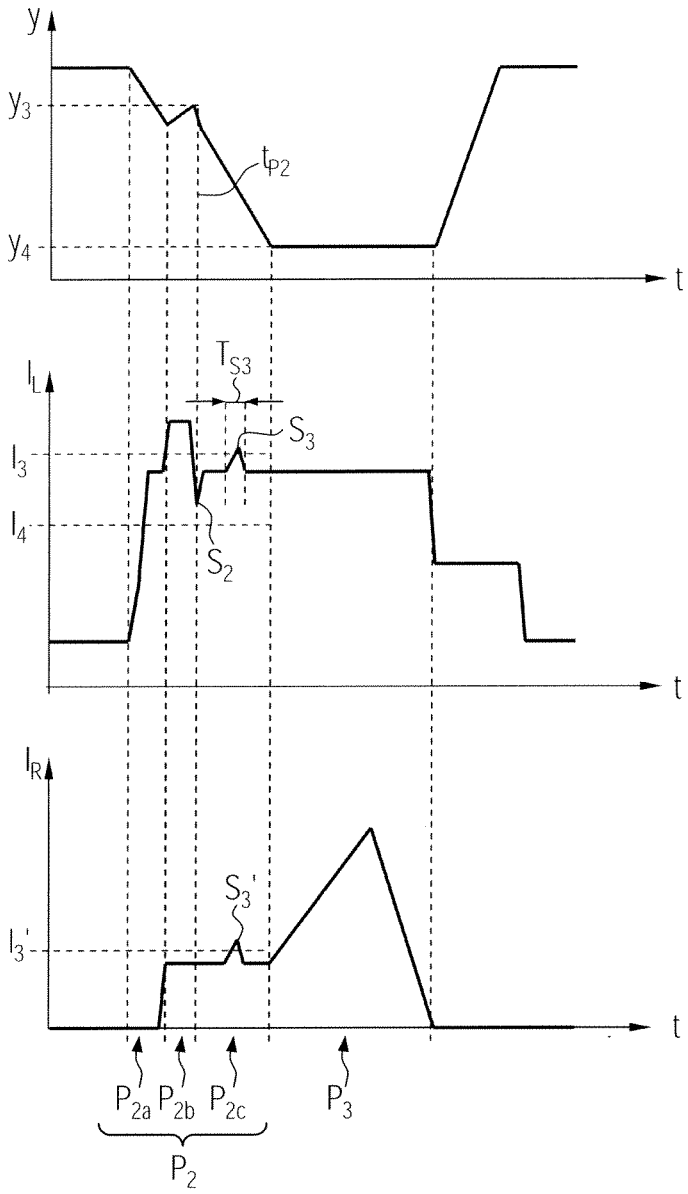
FIG. 3 shows a schematic place-time diagram of the closing head during placing, screwing on and tightening of a closing cap on a vessel mouth as well as corresponding current-time courses of a linear drive system and a rotatory drive system of the closing head.

The closing caps 4 are picked up and screwed on as described below, and the procedure is monitored by measuring the currents IL, IR and the linear position y of the closing head. Typical measured curves are represented in FIGS. 2 and 3, where, for the sake of simplicity, the currents IL and IR are always represented as positive values independent of their respective drive direction.

Accordingly, the closing head 3 is first lowered to a position y0 just above the closing cap 4 for taking or picking up the closing cap 4. As is schematically represented in FIG. 2, the current IL rises in the process from a basic value I0 for holding the closing head 3 against gravity to an essentially constant value during lowering. In an essentially centric position above the closing cap 4, the closing head 3 is then lowered for a second time in a pick phase P1, where a lower desired position yl at the end of the pick phase P1 can be determined from the known coordinates of the closing head 3, the closing cap 4 and the pick wheel 13 with respect to the linear axle L'.

An essentially constant current IL flows during a major part of the pick phase P1. However, the engagement of the closing cap 4 in the closing head 3, or the overcoming of a mechanical resistance in the centering and clamping device 3*a*, becomes noticeable by a momentary increase of the current IL in the form of a peak load S1. Typically, the peak load S1 is within a period TS1 which is preferably no longer than one fifth, in particular no longer than one tenth of the duration TP1 of the pick phase P1. The peak load S1 is typical of a correct engagement of the closing cap 4 and serves as characteristic comparative value which, when it occurs, expresses a normal behavior of the current IL. Thus, correct pick up of the closing cap 4 can be detected by means of the course of the current IL in the pick phase P1.

If the closing cap 4 is correctly picked up in the pick phase P1, the current IL remains within a certain measured value range at least except for the momentary fluctuation of current S1. Thus, an upper and a lower threshold value I1 and I2 can be defined, an error occurring if they are exceeded or fallen below. For example, a defective closing cap 4 with an asymmetrical cross-section can be pressed into the closing head 3 only with an increased mechanical resistance or not at all, whereby the current IL rises above the upper threshold value IL. However, if the closing cap 4 is missing, the current IL remains below the lower threshold value I2. The threshold values I1 and I2 are thus characteristic comparative values which express, if they are exceeded or fallen below, an abnormal behavior of the current IL. If required, frequency portions of the current signal IL separated by suited filtering can be compared with the characteristic values S1 and I1 or I2, respectively, to avoid incorrect interpretations. This is also true for the comparison with further characteristic values described below.

It can be even observed that the lower threshold value I2 is fallen below at least at the beginning of the pick phase P1 when a pilfer-proof band 4*a* is missing at the closing cap 4, as in this case the total height of the closing cap 4 is lower than with the pilfer-proof band 4*a*, and the closing head 3 touches the closing cap 4 later when it is lowered. The measurement of the current IL can here be compared with a simultaneous registration of the linear position y of the closing head 3 to increase the success probability and/or accuracy of error determination.

Thus, in the pick station 12 one can detect a damage or lack of the closing cap 4 by observing the current IL in the pick phase P1, and a subsequent incorrect closure in the closing station 11 can be avoided, for example, by not screwing a damaged closing cap 4 onto an associated bottle 2.

The placing, screwing on and tightening of the closing caps 4 in the closing station 11 is indicated by way of example in FIG. 3 with reference to phases P2 and P3. Accordingly, the closing caps 4 are lowered in the closing heads 3 at the beginning of the screw-on phase P2, a desired lift of the linear drive system L being specified, whereby the current IL in section P2*a* rises in particular while the closing cap 4 is being placed onto the bottle mouth 2*b*.

Due to the lift, the bottle collar 2*a* is pressed onto the spikes of the neck star 10 in the process. Here, it is possible to rotate the closing cap 4 in the closing direction or against the closing direction at the beginning P2*a* of the screw-on phase P2, or not to rotate it, as indicated in FIG. 3.

In FIG. 3, the closing cap 4 is rotated against the closing direction in section P2*b* after it has been pressed onto the spikes. The closing cap 4 seated on the thread of the bottle mouth 2*b* is first moved away from the bottle mouth 2*b* by this rotary motion as during the opening of the closure, whereby the contact pressure of the closing cap 4 and, as a consequence the current IL, further rise, until the convolutions of the closing cap 4 and the bottle mouth 2*b* pressed or sliding against each other engage or thread up at a point in time tP2.

Rotation against the closing direction in section P2*b* is not absolutely necessary, but has the advantage that the closing cap 4 engages abruptly and directly after a relative upper maximum position y3 of the closing head has been reached. A peak load S2 is connected with this, in particular a temporary drop of the current IL due to the momentarily lower contact pressure during engagement. To detect the peak load S2, an associated time window TS2 (not represented) can be defined within the screw phase P2. The characteristic fluctuation of current S2 can be used to determine a defined upper starting position y3 for the subsequent section P2*c* in which the closing cap 4 is screwed on in the closing direction. A desired value for a lower end position y4 can be calculated in turn from the upper starting position y3 when the closing cap 4 is completely screwed on for checking the screw-on procedure.

In section P2*c*, the closing head 3 is continuously drawn downwards by the convolution. Therefore, the contact pressure of the closing head 3 and thus the current IL are in this phase lower than directly before the threads sliding one upon the other are threaded up or engaged. The current IL is the smaller the smaller the difference between the lift of the closing head 3 and the movement of the closing cap 4 along the linear axle L' predetermined by the rotational speed about the axis of rotation R' and the thread pitch is.

In section P2*c*, a characteristic peak load S3 in the current IL can additionally occur during the approach of the pilfer-proof band 4*a* via the so-called pilfer-proof ring (not represented) which is provided at the bottle mouth 2*b* for fixing the pilfer-proof band 4*a*. Correspondingly, a peak S3' in the operating current IR of the rotatory drive system R can occur, where the power consumption IR of the rotatory drive system R is a measure for the torque or tightening torque of the closing head 3. Thus, the application of the pilfer-proof band 4*a* can also be monitored by recording the current IL or IR, respectively, where the peak loads S3 and S3' represent characteristic comparative values, from which one can gather, if they are missing, an abnormal behavior of the current IL or IR, respectively, caused by a lack of or an incorrectly applied pilfer-proof band 4*a*. Conversely, if the peak load S3 or S3' is detected, one can gather a correctly applied pilfer-proof band 4*a*.

In particular if a suited time window TS3 is specified in section P2*c*, one can also verify whether the current IL or IR, respectively, rises above a threshold value I3 or I3'. In this case, the threshold value I3 or I3' is a characteristic comparative value, where one can gather, if it is exceeded or permanently fallen below, a correctly or incorrectly applied pilfer-proof band 4*a*.

The screw-on phase 92 ends with the complete screwing-on of the closing cap 4, essentially as soon as the lower desired end position y4 of the closing head 3 is reached. As a mechanical resistance must occur at the desired end position y4 if the closing cap 4 is correctly screwed on, the current IL at the end position y4 must not be below a characteristic threshold value I4. Thus, the threshold value I4 can be consulted as characteristic comparative value for the current IL, from which one can detect, if it is exceeded or fallen below in section 2*c*, a correct or an incorrect seat of the closing cap 4 or a closure of the bottle 2. In addition, here, too, the current IR can be compared to a corresponding threshold value (not represented).

Following the screw phase P2 is the tightening phase P3 in which the closure is tightened by a dosed rise of the current IR of the rotatory drive unit R in a known manner until a certain tightening torque is reached, where the current IL of the linear drive unit L remains adjusted such that a sufficient contact pressure of the closing head 3 is ensured.

Subsequently, the closing head 3 is removed from the closing cap 4 or the closed bottle 2, respectively. The closing head 3 drives to a discharge position where, when it is reached, a possibly not screwed-on closing cap 4 still stuck in the closing head 3 is removed from the closing head, and it is then driven again to a starting position with respect to the pick station 12.

The evaluation of the current measurements for error detection or the determination of correct picking and closing is performed in a (non-depicted) evaluation unit 15 by comparing the measured current IL or IR with at least one characteristic comparative value, where the above described threshold values and peak loads can be arbitrarily combined as characteristic comparative values. Error messages can be given by suited (non-depicted) output units 16, for example by means of acoustic and/or optical signals. It is also possible to selectively control the production on the basis of the current measurements by means of a (non-depicted) control unit 17 in case of a detected incorrect closure and/or a detected imminent incorrect closure.

For example, incorrectly closed bottles 2 can be selectively discharged from the product stream by a (non-depicted) discharge device 18 downstream of the closing device, e.g. a pusher, by activating the discharge device by signals emitted by the control unit. Thereby, altogether a higher production quality can be achieved.

The current measurement here offers a variable possibility of detecting as correct or incorrect the course of closing in various phases of progression with only little equipment.

The invention claimed is:

1. Method for capping a vessel with a closure cap, comprising:

providing a closing head coupled to both a motor-driven linear drive system for lifting and lowering the closing head along a linear axle and a motor-driven rotary drive system for rotating the closing head;

driving the motor of the linear drive system during a pick phase to pick-up the cap and during a screw phase to lower the cap onto the vessel with the closing head;

at least one of: (i) measuring the power consumption of the linear drive system in the pick phase, or (ii) measuring the power consumption of the linear drive system in the screw phase; and comparing the measured power consumption with at least one characteristic value of power consumption to detect an incorrect operation during at least one of the pick phase or the screw phase.

2. Method according to claim 1, and determining the position of the closing head with respect to a linear axle of the linear drive system.

3. Method according to claim 1, wherein the characteristic value is an upper threshold value of the power consumption in the pick phase.

4. Method according to claim 1, wherein the characteristic value is a lower threshold value of the power consumption in the pick phase.

5. Method according to claim 1, wherein the characteristic value is a characteristic peak of the power consumption in the pick phase, and that it is verified whether the characteristic peak occurs in the pick phase.

6. Method according to claim 1, wherein the characteristic value is an upper threshold value of the power consumption in the screw phase.

7. Method according to claim 1, wherein the characteristic value is a characteristic peak of the power consumption in the screw phase, and that by means of the characteristic peak, determining a starting position of the closing head at the beginning of the thread formed by the closure cap and the vessel mouth.

8. Method according to claim 7, wherein by means of the starting position at the thread begin, calculating a lower desired end position of the closing head, and comparing the power consumption with a further characteristic value of the power consumption when the desired end position is reached.

9. Method according to claim 8, wherein the further characteristic value is a lower threshold value of the power consumption in the screw phase.

10. Method according to claim 1, and feeding the vessels as a continuous product stream, and discharging vessels having a defective closure alignment from the product stream.

11. Device for screw capping vessels, comprising:

at least one closing head for picking up and screwing on a closure cap onto a vessel;

a motor-driven linear drive system comprising a motor for lifting and lowering the closing head along a linear axle;

a motor-driven rotatory drive system comprising a motor for rotating the closing head about an axis of rotation;

a measuring means for measuring the power consumption of the motor of the linear drive system; and an evaluation unit for comparing the power consumption measured during at least one of picking up the closure cap or screwing on the closure cap, with a characteristic value of the power consumption to detect an incorrect operation during at least one of the picking up or screwing on of the closure cap.

12. Device according to claim 11, and a monitoring unit for determining the position of the closing head with respect to the linear axis.

13. Device according to claim 11, and a discharge device for discharging vessels having a defective closure alignment.

14. Device according to claim 11, and a control device which can control the linear drive system and the rotatory drive system such that only closure caps for which no defective alignment has been detected are screwed on.

15. Method according to claim 7, and wherein the characteristic peak of the power consumption in the screw phase is during rotation against the closing direction.

16. A device for capping a vessel with a closure cap, the device comprising:

a closing head configured to clamp and pick up the closure cap during a pickup phase and screw the closure cap onto the vessel during a screw phase;

a linear drive system comprising a motor and configured to: (i) move the closing head into contact with the closure cap during the pick phase so that the closing head is positioned to clamp and pick up the closure cap, and (ii) move the closing head and the closure cap toward the vessel during the screw phase;

a rotatory drive system comprising a motor and configured to rotate the closing head during the screw phase so that the closing head screws the closure cap onto the vessel;

a measuring unit configured to measure power consumption of the motor of the linear drive system during at least one of: (i) the pick phase including when the closing head is moved into initial contact with the closure cap, or (ii) the screw phase while the closure cap is lowered and screwed onto the vessel; and an evaluation unit configured to detect an incorrect operation during at least one of the pick phase or the screw phase by comparing a reference value of power consumption with at least one of: (i) the power consumption of the motor of the linear drive system measured by the measuring unit during the pick phase, or (ii) the power consumption of the motor of the linear drive system measured by the measuring unit during the screw phase.

17. Method according to claim 1, wherein in measuring the power consumption ($I_L$) of the linear drive system, the measurement performed during the pick phase measures the power consumption of the linear drive system while the linear drive system moves the closing head into initial contact with the closure cap.

18. Device according to claim 11, wherein the power consumption measured by the measuring means during picking up measures the power consumption of the linear drive system when the linear drive system moves the closing head into initial contact with the closure cap.

* * * * *